United States Patent [19]

Dean, Jr.

[11] Patent Number: 4,738,059

[45] Date of Patent: Apr. 19, 1988

[54] SPLIT MASONRY BLOCK, BLOCK WALL CONSTRUCTION, AND METHOD THEREFOR

[75] Inventor: Robert W. Dean, Jr., Milwaukee, Wis.

[73] Assignee: Designer Blocks, Inc., Milwaukee, Wis.

[21] Appl. No.: 825,046

[22] Filed: Jan. 31, 1986

[51] Int. Cl.[4] ..... E04C 1/00

[52] U.S. Cl. ..... 52/98; 52/316; 52/415; 52/561; 52/596; 52/747; D25/114

[58] Field of Search ..... 52/98, 100, 314, 316, 52/415, 561, 562, 596, 605-607, 747; D25/84, 86

[56] References Cited

U.S. PATENT DOCUMENTS

| | | | |
|---|---|---|---|
| 379,429 | 3/1888 | Werth | 52/98 |
| 415,773 | 11/1889 | Fiske | 52/316 |
| 787,199 | 4/1905 | Lloyd | 264/157 |
| 1,263,194 | 4/1918 | Blake | 138/115 |
| 1,323,512 | 12/1919 | Whitacre | 52/437 |
| 1,534,353 | 4/1925 | Besser | 52/315 |
| 1,583,921 | 5/1929 | Garber | 52/100 |
| 1,872,522 | 8/1932 | Stuckey | 264/157 |
| 1,893,430 | 1/1933 | McKenzie | 52/612 |
| 2,957,278 | 10/1960 | Woodworth | 52/316 |
| 4,335,549 | 6/1982 | Dean, Jr. | 52/98 |
| 4,516,364 | 5/1985 | Heider | 52/98 |

FOREIGN PATENT DOCUMENTS

| | | | |
|---|---|---|---|
| 187032 | 10/1956 | Austria . | |
| 204751 | 1/1959 | Austria | 52/100 |
| 79016 | 8/1950 | Czechoslovakia | 52/98 |
| 817950 | 8/1951 | Fed. Rep. of Germany | 52/98 |
| 2717176 | 10/1978 | Fed. Rep. of Germany | 52/100 |
| 1036508 | 9/1953 | France | 52/100 |
| 477661 | 1/1953 | Italy | 52/605 |
| 278210 | 1/1952 | Switzerland | 52/98 |
| 368290 | 5/1963 | Switzerland | 52/98 |
| 456902 | 7/1968 | Switzerland | 52/98 |
| 11582 | 7/1908 | United Kingdom . | |

OTHER PUBLICATIONS

J3474 V/37b 11-1955, German Printed Patent Application 1 dwg., 2 spec.

Pictorial Concrete Masonry/Office Buildings, vol. 35, No. 7, Jul. 1979, Pub. National Concrete Masonry Assoc., 2302 Horse Pen Road, Herndon, Va. 22070.

Best Block's Ribbed Split, Pub. Best Block Co., Butler, Wis.

Best Block's Flutted Split, Pub. Best Block Co., Butler, Wis.

Best Block's Split Stone, Pub. Best Block Co., Butler, Wis.

Best Block's Best Stone, Pub. Best Block Co., Butler, Wis.

National Concrete Masonry Assoc., NCMA-TED 40, 1972.

NCMA-TEK 42, 1972, Pub. National Concrete Masonry Assoc.

NCMA-TEK 49, 1973, Pub. National Concrete Masonry Assoc.

Vol. 16, No. 5, Pub. National Concrete Masonry Assoc.

*Primary Examiner*—John E. Murtagh

*Assistant Examiner*—Andrew Joseph Rudy

*Attorney, Agent, or Firm*—Andrus, Sceales, Starke & Sawall

[57] ABSTRACT

A split masonry block (50) formed of concrete-like material is provided with primary split surface areas (52, 54) and secondary split surface areas (56, 58, 60, 62). A wall (86) is constructed of such blocks so that the primary surface areas (52, 54) in one course are in vertical alignment with primary surface areas in adjacent courses, and the secondary surface areas (56, 58, 60, 62) are placed likewise. A composite module (10) is provided from which split blocks are formed.

14 Claims, 1 Drawing Sheet

SPLIT MASONRY BLOCK, BLOCK WALL CONSTRUCTION, AND METHOD THEREFOR

BACKGROUND AND SUMMARY OF THE INVENTION

This invention relates to a split masonry block formed from concrete, a masonry wall constructed of a plurality of such blocks laid up in courses, and a method of constructing such a wall.

Building blocks made from concrete or similar materials have been made in a variety of forms and configurations. Building blocks of this type have been irregularly shaped and/or colored to provide a decorative appearance when a wall or building is constructed using such blocks. In some constructions, two or more blocks have been molded as an integral module and thereafter split to provide an outer surface having a rough irregular decorative appearance on the split surface.

U.S. Pat. No. 4,335,549 to Dean, Jr. shows one block-forming method wherein a pair of concrete blocks are split from an integral module. The blocks are split along a plurality of splitting planes of different depths, to provide a front block surface having split surface areas on several different planes. The blocks so constructed are laid up in courses to form a masonry wall. The blocks are placed so that the split surface areas on any given plane in one course are out of vertical alignment with the split surface areas on the same plane in adjacent courses. A wall constructed according to U.S. Pat. No. 4,335,549 thus provides a wall having a plurality of surface areas of different depths for a random decorative appearance.

It is an object of the present invention to provide an improved concrete block split from a composite or integral module. Each block has one or more primary surface areas, and a plurality of secondary surface areas set back therefrom. A masonry wall made of blocks of the present invention has a series of vertically aligned surface areas, with the primary surface areas in one course placed in vertical alignment with the primary surface areas in adjacent courses, and the secondary surface areas placed likewise. It is a further object of the invention to provide a composite module from which such blocks may be formed. It is yet another object of the invention to provide a masonry wall having a plurality of vertically aligned split surface areas of different depths, for a decorative appearance. It is yet another object of the invention to provide a method of constructing such a wall.

In accordance with one aspect of the invention, a composite module is provided with a pair of oppositely spaced back walls substantially parallel to a longitudinal axis, and a pair of oppositely spaced side walls substantially parallel to a transverse axis. Each of the side walls has a pair of indentations which define spaced first and second splitting planes.

In accordance with another aspect of the invention, the module is provided with a pair of cavities which define a third splitting plane located between the first and second splitting planes. Each cavity is of sufficient transverse width to intersect the first and second splitting planes.

In accordance with yet another aspect of the invention, the module as described is split along the portion of the first and second splitting planes lying between the indentations and the cavities, and also split along the portion of the third splitting plane lying between the pair of cavities. A pair of blocks is thus formed with each block having a primary surface portion formed by the split along the third splitting plane, and a pair of secondary surface portions formed by the splits along the first and second splitting planes.

In accordance with yet another aspect of the invention, a further pair of cavities may be located along the longitudinal axis between the first pair of cavities. A further secondary surface portion is thus formed on the pair of blocks when the module is split as previously described, and also split along the portion of the first and second splitting planes lying between the second pair of cavities.

In accordance with yet another aspect of the invention, the module may have a further cavity located longitudinally between the second pair of cavities. Yet another secondary surface portion is thus formed on the pair of blocks when the module is split as previously described, and also split along the portion of the first and second splitting planes lying between the second pair of cavities.

In accordance with yet another aspect of the invention, a concrete block is provided with a plurality of primary surface portions split along a first splitting plane spaced from the back surface by a first distance, and a plurality of secondary surface portions split along a second splitting plane spaced from the back surface by a second distance less than the first distance. Each primary surface area has at least one secondary surface area adjacent thereto. The concrete block thus has a front block surface having a plurality of primary and secondary split surface areas of different depths, for a decorative appearance.

In accordance with yet another aspect of the invention, a masonry wall is constructed of a plurality of such blocks laid up in courses. The wall is constructed so that the primary surface areas in one course are placed in vertical alignment with the primary surface areas in adjacent courses. The secondary surface areas in one course are also placed in vertical alignment with the secondary surface portions in adjacent courses.

In accordance with yet another aspect of the invention, a method of constructing a masonry wall having a series of vertically aligned surface areas of different depths for a decorative appearance is provided.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
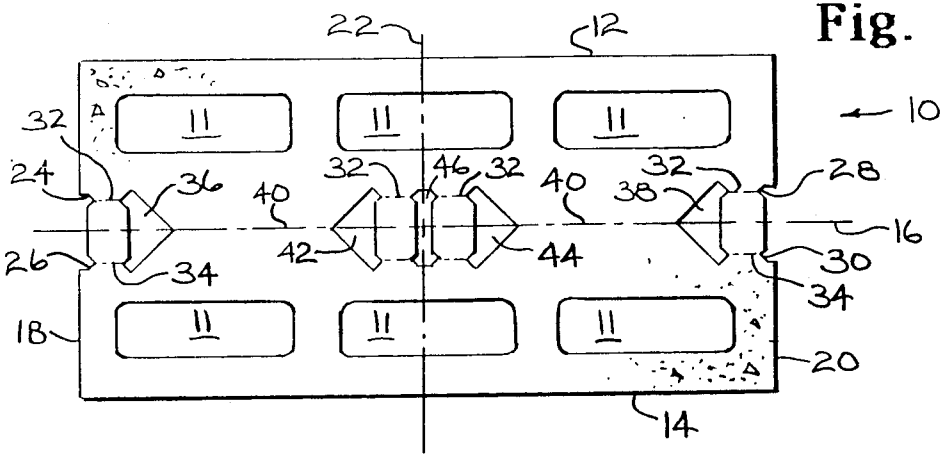
FIG. 1 is a top plan view of a composite module from which a pair of blocks is formed.

As shown in FIG. 1, a composite module 10 is provided, from which a pair of masonry blocks are formed. Module 10 is preferably formed from a concrete-like material. Module 10 may have one or more central cores 11 formed in a customary fashion. As shown, module 10 has six cores 11. Module 10 is provided with a first back wall 12 and a second back wall 14. Back walls 12 and 14 are substantially parallel to a longitudinal axis 16. Module 10 is further provided with a first side wall 18 and a second side wall 20. Side walls 18 and 20 are substantially parallel to a transverse axis 22.

Side wall 18 has indentations 24 and 26, and side wall 20 has indentations 28 and 30. Indentations 24 and 28 define a first splitting plane 32, and indentations 26 and 30 define a second splitting plane 34. Splitting planes 32 and 34 are substantially parallel to longitudinal axis 16. Indentations 24 and 28 are spaced from back wall 12 a predetermined distance less than half the dimension of side wall 18, and indentations 26 and 30 are spaced from back wall 14 by the same distance.

Module 10 is also provided with cavities 36 and 38, which define a third splitting plane 40. Splitting plane 40 is also parallel to longitudinal axis 16, and is substantially centrally located between back walls 12 and 14. Cavities 36 and 38 are of sufficient transverse width to intersect splitting planes 32 and 34, as well as plane 40. First cavity 36 is longitudinally spaced from side wall 18, and second cavity 38 is longitudinally spaced from side wall 20 and first cavity 36. As shown, cavities 36 and 38 are spaced an equal distance from side walls 18 and 20.

In the preferred embodiment shown in FIG. 1, module 10 is further provided with a third cavity 42 and a fourth cavity 44. Cavities 42 and 44 are substantially centrally located along longitudinal axis 16 between cavities 36 and 38. Cavities 42 and 44 are also of sufficient transverse width to intersect splitting planes 32 and 34, as well as plane 40.

Module 10 preferably has a fifth cavity 46 located longitudinally between cavities 42 and 44. Cavity 46 is also of sufficient transverse width to intersect splitting planes 32, 34 and 40.

Figure 2:
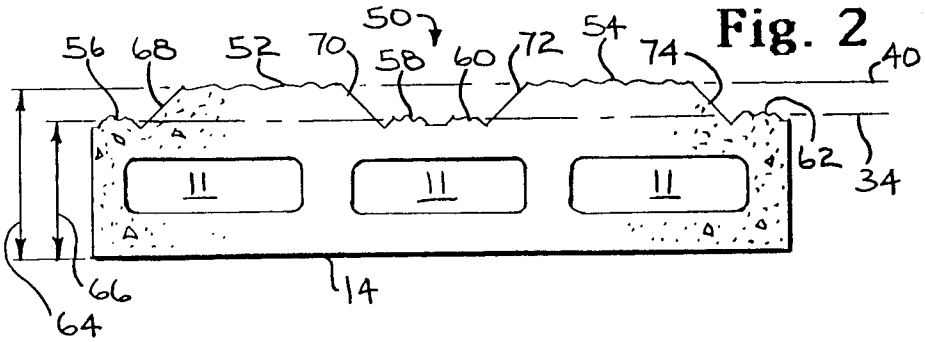
FIG. 2 is a top plan view of a split concrete block formed from the module of FIG. 1.

FIG. 2 shows a split concrete block 50 formed from composite module 10. A pair of blocks such as split block 50 are formed when module 10 is split along splitting planes 32 and 34 between: indentations 24 and 26 and cavity 36; indentations 28 and 30 and cavity 38; cavity 42 and 46; cavity 44 and 46; and also split along splitting plane 40 between cavities 36 and 42, and cavities 38 and 44. Module 10 may be split according to any splitting means or technique known in the art, such as that disclosed in previously referenced U.S. Pat. No. 4,335,549.

Split block 50 has a front block surface having primary surface areas 52 and 54 formed by the splits along splitting plane 40, and secondary surface areas 56, 58, 60, and 62 formed by the splits along splitting plane 34. As shown, primary surface area 52 has secondary surface areas 56 and 58 adjacent thereto, and primary surface area 54 has secondary surface areas 60 and 62 adjacent thereto.

As shown in FIG. 2, splitting plane 40 is spaced from a reference plane provided by back wall 14 by a distance 64. Splitting plane 34 is spaced from back wall 14 by a distance 66, which is less than distance 64. The front surface of split block 50 thus provides a plurality of primary and secondary distinct split surface areas of different depths for a decorative appearance.

Secondary surface areas 56 and 58 may be joined to primary surface area 52 by surface areas 68 and 70, which are disposed at an angle to splitting planes 34 and 40. Likewise, secondary surface areas 60 and 62 may be joined to primary surface area 54 by surface areas 72 and 74, which are also disposed at an angle to planes 34 and 40.

In an alternative embodiment, module 10 may be formed without cavities 42, 44, and 46. When so formed, module 10 is split along splitting planes 32 and 34 between indentations 24 and 26 and cavity 36, and between indentations 28 and 30 and cavity 38. Module 10 is also split along splitting plane 40 between cavities 36 and 38. When so split, a pair of concrete blocks is formed with each block having a single primary surface are formed by the split along splitting plane 40. Secondary surface portions are formed by the splits along splitting planes 32 and 34, with one secondary surface area being on each side of the single primary surface area. The present invention provides a wall constructed of blocks formed according to the alternative embodiment, and also provides a method of constructing such a wall.

Figure 4:
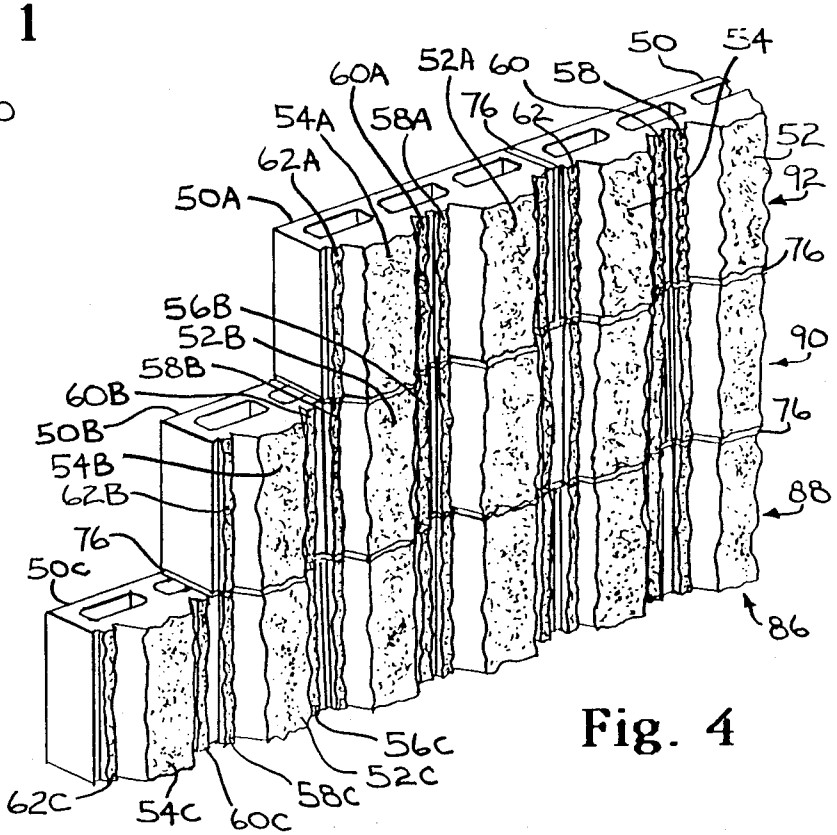
FIG. 4 is a perspective view of a section of a wall constructed according to the invention.
Figure 3:
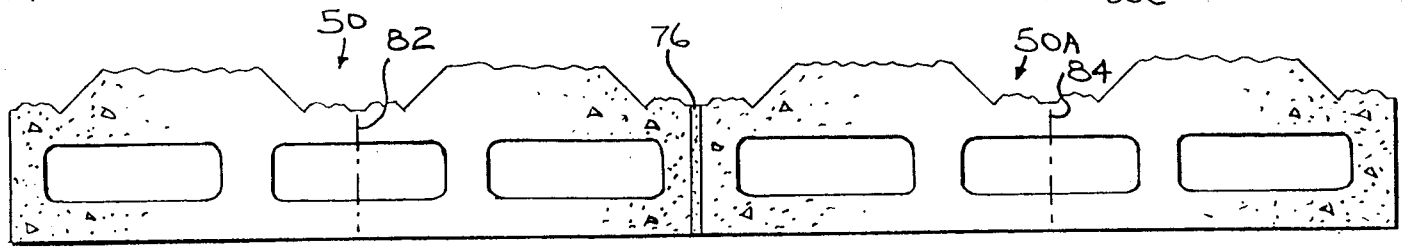
FIG. 3 is a top plan view showing the manner in which blocks such as that in FIG. 2 are placed in a wall.

FIGS. 3 and 4 show a series of blocks such as split block 50 as they appear in a wall. In FIGS. 3 and 4, the letters A, B, C, etc. are added to reference characters to indicate distinct blocks, each of which is substantially similar to split block 50 of FIG. 2. As shown in FIG. 3, split blocks 50 and 50A are laid endwise in a course. Blocks 50 and 50A are joined by joint mortar 76 placed therebetween. Dashed lines 82 and 84 indicate the planes in which the ends of a further split block are preferably placed in the immediately adjacent course.

FIG. 4 shows a portion of a masonry wall 86 constructed of concrete blocks 50, 50A, 50B, 50C, etc. The concrete blocks are substantially identical, having been symmetrically formed from modules such as composite module 10. The concrete blocks in wall 86 are laid up in courses 88, 90, and 92. Each block is connected to adjacent blocks by conventional mortared joints 76. The courses 88, 90, and 92 have been laid in a running bond so that a single block in upper courses will rest upon two lower blocks to form the wall 86.

The wall 86 provides a distinct decorative appearance in that each primary distinct split surface area in one course is placed in vertical alignment with a primary distinct split surface area in adjacent courses. For example, as shown in FIG. 4, primary surface area 54B is placed in vertical alignment with primary surface area 52C. Likewise, the secondary surface areas in one course are also placed in vertical alignment with secondary surface areas in adjacent courses. For example, secondary surface area 62B is placed in vertical alignment with secondary surface area 58C, and so on. In this manner, wall 86 provides a masonry wall having a series of vertically aligned surface areas of different depths. The wall so constructed provides a highly decorative appearance, in that the vertically aligned surface areas provide the effect of a wall made up of a series of columns.

Various modes of carrying out the invention are contemplated as being within the scope of the following claims particularly pointing out and distinctly claiming the subject matter which is regarded as the invention.

I claim:

1. A composite masonry module (10) formed from concrete-like material from which a pair of masonry blocks are formed, said module comprising:

first and second oppositely spaced back walls (12, 14) substantially parallel to a longitudinal axis (16), and first and second oppositely spaced side walls (18, 20) substantially parallel to a transverse axis (22);

said side walls each having a pair of indentations (24, 26; 28, 30) which define spaced first and second splitting planes (32, 34) substantially parallel to said longitudinal axis (16);

a pair of cavities (36, 38) which define a third splitting plane (40) disposed substantially parallel to said longitudinal axis (16), said cavities intersecting said first, second and third splitting planes (32, 34);

the first cavity (36) of said pair of cavities being longitudinally spaced from said first side wall (18) and the second cavity (38) of said pair of cavities being longitudinally spaced from said first cavity (36), so that when said module is split along the portion of said first and second splitting planes (32, 34) lying between said indentations (24, 26; 28, 30) and said cavities (36; 38), and is also split along the portion of said third splitting plane (40) lying between said pair of cavities (36, 38), a pair of blocks is formed with each block having a primary split surface area (52) facing outwardly away from the back wall of said block formed by the split along said third splitting plane (40), and a pair of coplanar secondary split surface areas (56, 62) facing outwardly in substantially the same direction as said primary split surface area and being disposed one on either side thereof formed by the splits along said first and second splitting planes (32, 34) for a decorative appearance.

2. The composite masonry module of claim 1 wherein the first indentation (24, 28) in each of said pair of indentations is spaced from said first back wall (12) a first predetermined distance less than half the dimension of said side wall, and the second indentation (26, 30) in each of said pair of indentations is spaced from said second back wall (14) a second predetermined distance less than half the dimension of said side wall.

3. The composite masonry module of claim 2 wherein said first and second predetermined distances are substantially equal.

4. The composite masonry module of claim 3 wherein said third splitting plane (40) is substantially centrally located between said first and second back walls (12, 14) along said longitudinal axis.

5. The composite masonry module of claim 1 which further includes a second pair of cavities (42, 44) substantially centrally located along said longitudinal axis (16) between said first-named pair of cavities (36, 38) and intersecting said first, second and third splitting planes (33, 34), so that a further coplanar secondary split surface area (58) is formed on said pair of blocks when said module is split along the portion of said first and second splitting planes (32, 34) lying between said second pair of cavities, and so that a further primary split surface area (54) is formed when said module in split along the portions of said third splitting plane (40) lying between said first-named and said second pairs of cavities.

6. The composite masonry module of claim 5 which includes a further cavity (46) located longitudinally between said second pair of cavities (42, 44) and intersecting said first, second and third splitting planes (32, 34), so that a further coplanar secondary split surface area (60) is formed on said pair of blocks when said module is split along the portion of said first and second splitting planes (32, 34) lying between said second pair of cavities (42, 44).

7. A composite masonry module (10) formed from concrete-like material from which a pair of masonry blocks are formed, said module comprising:

first and second oppositely spaced back walls (12, 14) substantially parallel to a longitudinal axis (16), and first and second oppositely spaced side walls (18, 20) substantially parallel to a transverse axis (22);

said side walls each having a pair of indentations (24, 26; 28, 30) therein which define spaced first and second splitting planes (32, 34) substantially parallel to said longitudinal axis (16), wherein the first indentation (24, 28) in each of said pair of indentations is spaced from said first back wall (12) a first predetermined distance less than half the dimension of said side wall, and the second indentation (26, 30) in each of said pair of indentations is spaced from said second back wall (14) a second predetermined distance equal to said first predetermined distance;

a first pair of cavities (36, 38) which define a third splitting plane (40) disposed substantially parallel to said longitudinal axis (16) and substantially centrally located between said first and second back walls (12, 14), said first pair of cavities intersecting said first, second and third splitting planes (32, 34);

the first cavity (36) of said pair of cavities being longitudinally spaced from said first side wall (18) and the second cavity (38) of said pair of cavities being longitudinally spaced from said first cavity (36);

a second pair of cavities (42, 44) substantially centrally located along said longitudinal axis (16) between said first pair of cavities (36, 38), said second pair of cavities intersecting said first, second and third splitting planes (32, 34); and a further cavity (46) located longitudinally between said second pair of cavities (42, 44) and intersecting said first, second and third splitting planes (32, 34), so that when said module is split along the portion of said first and second splitting planes (32, 34) lying between said indentations (24, 26; 28, 30) and said first pair of cavities (36; 38), and is also split along the portion of said first and second splitting planes (32, 34) lying between said second pair of cavities (42, 44), and is also split along the portion of said third splitting plane (40) lying between each of said first and second pair of cavities (36, 42; 38, 44), a pair of blocks is formed with each block having a pair of primary split surface areas (52, 54) facing outwardly away from the back wall of said block formed by the splits along said third splitting plane (40), and a plurality of coplanar secondary split surface areas (56, 58, 60, 62) facing outwardly in substantially the same direction as said primary split surface area and being disposed one on either side thereof formed by the splits along said first and second splitting planes (32, 34), each of said primary split surface areas (52, 54) having at least one of said secondary split surface areas (56, 58, 60, 62) adjacent thereto, for a decorative appearance.

8. In a masonry block (50) formed from a concrete-like material and having a plurality of surfaces including a back surface (14), a front block surface comprising:

a plurality of coplanar primary distinct split surface areas (52, 54) facing outwwardly away from said back surface, said primary split surface areas being split generally along a first splitting plane (40) spaced from a reference plane provided by said back surface (14) by a first distance (64), said primary distinct split surface areas being formed by splitting away portions of said concrete-like material integrally formed with portions of said front block surface prior to being split away therefrom; and a plurality of coplanar secondary distinct split surface areas (56, 58, 60, 62) facing outwardly away from said back surface in generally the same direction as said primary split surface areas, said secondary split surface areas being split generally along a second splitting plane (34) spaced from said reference plane (14) by a second distance (66) less than said first distance (64), said secondary distinct split surface areas being formed by splitting away portions of said concrete-like material integrally formed with portions of said front block surface prior to being split away therefrom, to provide a plurality of coplanar secondary split surface areas (56, 58, 60, 62) spaced from said back surface a distance less than said plurality of primary distinct split surface areas whereby recessed areas are provided between said primary split surface areas, said coplanar secondary split surface areas being readily distinguishable from said coplanr primary split surface areas (52, 54), each of said primary split surface areas (52, 54) having at least one of said secondary split surface areas (56, 58, 60, 62) adjacent thereto;

so that said front block surface provides a plurality of said primary and secondary distinct split surface areas of different depths facing generally outwardly away from said back surface for a decorative appearance.

9. The masonry block of claim 8 wherein said first and second splitting planes (34, 40) are substantially parallel.

10. The masonry block of claim 8 wherein said primary (52, 54) and secondary (56, 58, 60, 62) split surface areas are joined by a further surface area (68, 70, 72, 74) disposed at an angle to all of said planes.

11. A masonry wall (86) constructed of a plurality of blocks (50, 50A, 50B, 50C) laid up in courses (88, 90, 92) with mortared joints therebetween (76), in said wall having a plurality of surfaces including a back surface, and a front block surface comprising:

a primary distinct split surface area facing outwardly away from said back surface, said primary split surface area being split generally along a first splitting plane (40) spaced from a reference plane provided by said back surface by a first distance, said primary distinct split surface area being formed by splitting away a portion of said concrete-like material integrally formed with a portion of said front block surface prior to being split away therefrom; and a plurality of coplanar secondary distinct split surface areas facing outwardly from said back surface in generally the same direction as said primary split surface area, said secondary split surface areas being split generally along a second splitting plane (34) spaced from said reference plane by a second distance less than said first distance, said secondary distinct split surface areas being formed by splitting away portions of said concrete-like material integrally formed with portions of said front block surface prior to being split away therefrom, to provide a plurality of coplanar secondary split surface areas, said secondary split surface areas being arranged so that at least one said secondary split surface area is disposed on either side of said primary split surface area, said secondary split surface areas being spaced from said back surface a distance less than said primary split surface area whereby recessed areas are provided on either side of said primary split surface area, said secondary split surface areas being readily distinguishable from said primary split surface area;

said primary and secondary split surface areas of blocks laid in one said course being disposed in vertical alignment with said primary and secondary split surface areas of blocks laid in adjacent courses to thereby provide a masonry wall having a plurality of vertically aligned split surface areas of different depths facing generally outwardly away from said back surface for a decorative appearance.

12. A masonry wall (86) constructed of a plurality of blocks (50, 50A, 50B, 50C) laid up in courses with mortared joints therebetween (76), each said block having a plurality of surfaces including a back surface (14), and a front surface comprising:

a plurality of coplanar primary distinct split surface areas (52, 54) facing outwardly away from said back surface, said primary split surface areas being split generally along a first splitting plane (40) spaced from a reference plane provided by said back surfaces (14) by a first distance, said primary distinct split surface areas being formed by splitting away portions of said concrete-like material integrally formed with portions of said front block surface prior to being split away therefrom; and a plurality of coplanar secondary distinct split surface areas (56, 58, 60, 62) facing outwardly away from said back surface in generally the same direction as said primary split surface areas, said secondary split surface areas being split generally along a second splitting plane (34) spaced from said reference plane by a second distance (66) less than said first distance (64), said secondary distinct split surface areas being formed by splitting away portions of said concrete-like material integrally formed with portions of said front block surface prior to being split away therefrom, to provide a plurality of coplanar secondary split surface areas spaced from said back surface a distance less than said plurality of primary distinct split surface areas whereby recessed areas are provided between said primary split surface areas, said coplanar secondary split surface areas being readily distinguishable from said coplanar primary split surface areas, each of said primary split surface areas (52, 54) having at least one of said secondary split surface areas (56, 58, 60, 62) adjacent thereto;

said primary and secondary split surface areas in one said course (90) being disposed in vertical alignment with said primary and secondary split surface areas in adjacent courses (88, 92) to thereby provide a masonry wall (86) having a series of vertically aligned split surface areas of different depths facing generally outwardly away from said back surface for a decorative appearance.

13. A method of constructing a building wall comprising the steps of:

providing a series of split rectangular blocks of concrete-like material with each of said blocks having a plurality of surfaces including a back surface, and a front surface comprising a primary distinct split surface area facing outwardly away from said back surface, said primary split surface area being split generally along a first splitting plane (40) spaced from a reference plane provided by said back surface by a first distance, said primary distinct split surface area being formed by splitting away a portion of said concrete-like material integrally formed with a portion of said front block surface prior to being split away therefrom, and a plurality of coplanar secondary distinct split surface areas facing outwardly from said back surface in generally the same direction as said primary split surface area, said secondary split surface areas being split generally along a second splitting plane (34) spaced from said reference plane by a second distance less than said first distance, said secondary distinct split surface areas being formed by splitting away portions of said concrete-like material integrally formed with portions of said front block surface prior to being split away therefrom, to provide a plurality of coplanar secondary split surface areas, said secondary split surface areas being arranged so that at least one said secondary split surface area is disposed on either side of said primary split surface area, said secondary split surface areas being spaced from said back surface a distance less than said primary split surface area whereby recessed areas are provided on either side of said primary split surface area, said secondary split surface areas being readily distinguishable from said primary split surface area;

applying joint mortar (76) to the top surfaces of the blocks in underlying courses;

placing said blocks so that said primary and secondary split surface areas in one said course (90) are in vertical alignment with said primary and secondary split surface areas in said underlying courses (88); and laying said blocks abutting endwise in courses upon said joint mortar (76), to provide a masonry wall having a series of vertically aligned split surface areas of different depths facing generally outwardly away from said back surface for a decorative appearance.

14. A method of constructing a building wall comprising the steps of:

providing a series of split rectangular blocks of concrete-like material with each of said blocks having a plurality of surfaces including a back surface (14), and a front surface comprising a plurality of coplanar primary distinct split surface areas (52, 54) facing outwardly away from said back surface, said primary split surface areas being split generally along a first splitting plane (40) spaced from a reference plane provided by said back surface (14) by a first distance (64), said primary distinct split surface areas being formed by splitting away portions of said concrete-like material integrally formed with portions of said front block surface prior to being split away therefrom, and a plurality of coplanar secondary distinct split surface areas (56, 58, 60, 62) facing outwardly away from said back surface in generally the same direction as said primary split surface areas, said secondary split surface areas being split generally along a second splitting plane (34) spaced from said reference plane (14) by a second distance (66) less than said first distance (64), said secondary distinct split surface areas being formed by splitting away portions of said concrete-like material integrally formed with portions of said front block surface prior to being split away therefrom, to provide a plurality of coplanar secondary split surface areas spaced from said back surface a distance less than said plurality of primary distinct split surface areas whereby recessed areas are provided between said primary split surface areas, said coplanar secondary split surface areas being readily distinguishable from said coplanar primary split surface areas, each of said primary split surface areas (52, 54) having at least one of said secondary split surface areas (56, 58, 60, 62) adjacent thereto;

applying joint mortar (76) to the top surfaces of the blocks in underlying courses (88); and laying said blocks abutting endwise in courses upon said joint mortar (76), to provide a masonry wall (86) having a series of vertically aligned split surface areas of different depths facing generally outwardly away from said back surface for a decorative appearance.

* * * * *

UNITED STATES PATENT AND TRADEMARK OFFICE

CERTIFICATE OF CORRECTION

PATENT NO. : 4,738,059

DATED : April 19, 1988

INVENTOR(S) : Robert W. Dean, Jr.

It is certified that error appears in the above-identified patent and that said Letters Patent is hereby corrected as shown below: Title page:

At [56], Other Publications, Delete "NCMA-TED" and substitute therefor ---NCMA-TEK---;

Col. 4, line 12, Delete "are" and substitute therefor ---area---;

Claim 5, col. 5, line 56, Delete "in"and substitute therefor ---is---;

Claim 8, col. 6, line 64, Delete "outwwardly" and substitute therefor ---outwardly---;

Claim 8, col. 7, line 24, Delete "coplanr" and substitute therefor ---coplanar---;

Claim 11, col. 7, line 42, After "(76)," insert ---each said block---; and

Claim 12, col. 8, line 28, Delete "surfaces" and substitute therefor ---surface---.

Signed and Sealed this

Seventh Day of March, 1989

*Attest:*

DONALD J. QUIGG

*Attesting Officer*

*Commissioner of Patents and Trademarks*